US006568119B2

(12) United States Patent
Schoemaker et al.

(10) Patent No.: US 6,568,119 B2
(45) Date of Patent: May 27, 2003

(54) INTERCHANGEABLE SHOTGUN SIGHT

(75) Inventors: Duane L. Schoemaker, Womelsdorf, PA (US); Mark A. Bansner, Adamstown, PA (US); Thomas C. Walser, West Chester, PA (US)

(73) Assignee: Sight Right, Inc., West Chester, PA (US)

( * ) Notice: Subject to any disclaimer, the term of this patent is extended or adjusted under 35 U.S.C. 154(b) by 0 days.

(21) Appl. No.: 09/902,817

(22) Filed: Jul. 12, 2001

(65) Prior Publication Data

US 2003/0009925 A1 Jan. 16, 2003

(51) Int. Cl.[7] ..... F41G 1/00; F41G 1/02; F41G 1/033

(52) U.S. Cl. ..... 42/135; 42/111; 42/113; 42/134

(58) Field of Search ..... 42/111, 113–116, 42/120–122, 124–126, 134–136, 138, 139

(56) References Cited

U.S. PATENT DOCUMENTS

| | | | | | |
|---|---|---|---|---|---|
| 1,683,106 | A | * | 9/1928 | Schrank | 42/111 |
| 2,306,176 | A | * | 12/1942 | Mathis | 42/79 |
| 3,353,291 | A | * | 11/1967 | Musser | 42/134 |
| 3,646,682 | A | * | 3/1972 | Edwin | 42/144 |
| 3,648,374 | A | * | 3/1972 | Lewis | 42/136 |
| 4,044,486 | A | | 8/1977 | Van Holten | 42/1 |
| 4,606,131 | A | * | 8/1986 | Domian | 42/137 |
| 4,683,662 | A | * | 8/1987 | Kiss, Jr. | 42/144 |
| 4,833,810 | A | * | 5/1989 | Domian | 42/137 |
| 4,859,058 | A | * | 8/1989 | Ekstrand | 356/251 |
| 4,878,308 | A | | 11/1989 | Rose | 42/102 |
| 4,976,038 | A | * | 12/1990 | Nattrass | 42/111 |
| 5,016,381 | A | * | 5/1991 | Ferraro | 42/148 |
| 5,150,527 | A | * | 9/1992 | Knoster | 279/2.22 |
| 5,396,708 | A | * | 3/1995 | Whitley | 279/2.02 |
| 5,486,913 | A | * | 1/1996 | Aharon | 356/153 |
| 5,724,761 | A | * | 3/1998 | Bergacker | 42/123 |
| 5,836,100 | A | * | 11/1998 | Stover | 42/132 |
| 5,862,618 | A | | 1/1999 | Brown | 42/100 |
| 5,878,503 | A | | 3/1999 | Howe et al. | 33/241 |
| 5,926,963 | A | | 7/1999 | Knight | 33/241 |
| 5,992,291 | A | | 11/1999 | Widder et al. | 898/14.05 |
| 6,293,040 | B1 | * | 9/2001 | Luth | 42/75.01 |

* cited by examiner

*Primary Examiner*—Charles T. Jordan
*Assistant Examiner*—Tara M Golba
(74) *Attorney, Agent, or Firm*—Martin Fruitman

(57) ABSTRACT

The apparatus is an adjustable front sighting system for a shotgun. Interchangeable rings, each with a sight point mounted at a different height above the rings, are slipped over the discharge end of a tube attached to the muzzle of a shotgun and clamped in place by a threaded nut. The shotgun's elevation can thus be adjusted by interchanging rings with sight points at differing heights, and windage can be adjusted by rotating any installed ring in an arc to the left or right.

8 Claims, 5 Drawing Sheets

INTERCHANGEABLE SHOTGUN SIGHT

FIELD OF THE INVENTION

The present invention relates generally to a shotgun sighting system and more specifically of an improved means for adjusting the shotguns point of impact for elevation and windage.

BACKGROUND OF THE INVENTION

In the sport of shotgun shooting, such as hunting waterfowl or shooting at high speed clay targets, the shooter must be able to quickly and accurately mount or bring the gun barrel up to firing position, and, just as accurately, acquire the target and determine where to point or aim the gun. The shooter must take many variables into consideration, including the speed of the target, the angle between the shooter and the target, and the windspeed and direction. Further, the shooter must also consider the sighting and aiming characteristics of the shotgun itself, particularly the point of impact.

In U.S. Pat. No. 4,878,308 by Rose it is stated that it is considered highly desirable for a shooter to be able to adjust the shotgun's point of impact, which is generally described as where, using a standard distance such as 40 yards, the shot pellet cloud hits the target in relation to where the gun was actually aimed. One method shotgun enthusiasts have traditionally used to adjust their shotguns to achieve proper point of impact has been to literally bend the shotgun barrel to correct for misalignments and other variables in aim, so that the shot cloud hits where the gun is aimed. Other, less drastic methods for accomplishing this result, have included mounting adjustable sighting beads at the breach and/or muzzle end of the shotgun barrel, so that the shooter can adjust the gun's point of impact, and elevation in the vertical plane. Some methods have also added intricate mechanisms for vertically adjusting a raised rib mounted along the length of the shotgun barrel. None of these methods, however, provide the shooter with the ability to adjust the shotgun's point of impact in the horizontal plane, commonly referred to as windage.

These prior methods are complex and cumbersome, however, and, as stated, do not address the need to also adjust the point of impact in the horizontal plane, as may be necessary due to either the wind's influence on the shotgun pellets, the target's horizontal motion, the gun's own shooting characteristics, or some combination thereof. In addition, the prior methods do not suggest a sighting system in which the shooter can quickly and easily adjust the gun's point of impact, in both the vertical plane and the horizontal planes.

SUMMARY OF THE INVENTION

The present invention not only solves the needs noted above, but also provides a new and unanticipated benefit, in that it is portable, and can be quickly and easily removed from one shotgun and installed in another shotgun whose barrel is threaded to accept the present invention. In this manner the point of impact of the second shotgun can also be quickly and easily corrected.

The present invention provides a system of interchangeable sight points, preferably of the fiber optic variety, which are mounted onto sight mounting rings which slip over a tube which extends from the shotgun barrel. More specifically, the apparatus is typically assembled as follows.

The end of a tube is screwed into the threaded muzzle end of a shotgun barrel. The end of the tube screwed into the barrel is hereafter referred to as the inside end. A sight mounting ring, whose inner diameter matches, or is slightly larger than, the outer diameter of the tube, is slipped over the discharge end of the tube until it makes contact with a raised stop running circumferentially around the exterior surface of the tube. An annular threaded nut, whose interior threads match threads located on the discharge end of the tube, is then threaded onto the discharge end of the tube such that as it threads itself toward the inside end of the tube it pinches or clamps the sight mounting ring against the raised stop.

Once the apparatus is assembled as described above, the point of impact may be adjusted in the horizontal plane by loosening the threaded nut, rotating the installed sight mounting ring and sight point to the desired location either on the left or right side of the barrel, and retightening the threaded nut. Similarly, the shotgun's point of impact may be adjusted in the vertical plane by loosening and removing the threaded nut, sliding the sight mounting ring off the discharge end of the tube, and replacing it with another sight mounting ring having its sight point at a different height above the barrel, either higher or lower, and retightening the threaded nut. Such elevation and windage adjustments can also be made in the same manner in the field.

As can be appreciated, the sighting apparatus of the present invention is portable, and may be quickly and easily removed, wholly intact, from the original shotgun and installed on any other long barreled firearm with a similarly threaded barrel.

DETAILED DESCRIPTION OF THE INVENTION

Figure 1:
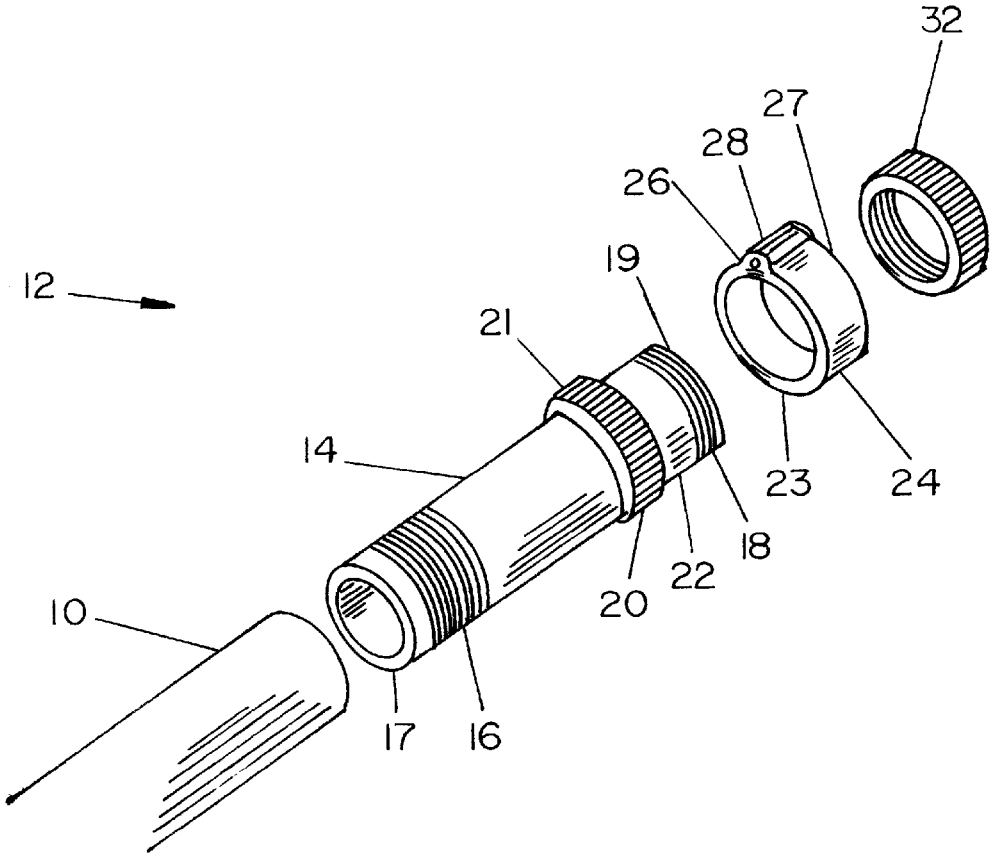
FIG. 1 is an exploded perspective view of the elements of shotgun sighting apparatus of the present invention.

FIG. 1 is an exploded perspective view of the elements of shotgun sighting apparatus 12 of the present invention. FIG. 1 depicts cylindrical tube 14, having exterior threads 16 near its inside end 17, exterior threads 18 at its discharge end 19, and raised stop 20 running around its circumference at a location near discharge end 19 of tube 14. Between raised stop 20 and threads 18 there is a section 22 of the outer surface of tube 14. In the preferred embodiment the surface of raised stop 20 is machined as a straight knurl.

Figure 2:
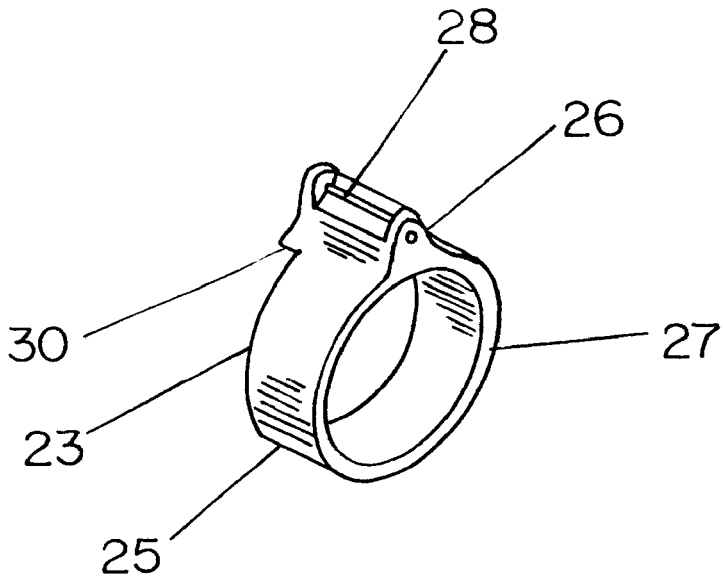
FIG. 2 is a perspective view of one embodiment of a sight mounting ring.

Both sight mounting rings 24 and 25 of FIGS. 1 and 2 have inside diameters which match, or slightly exceed the outside diameter of the discharge end of tube 14, so that sight mounting ring 24 or 25 can easily be slipped over discharge end 19 of tube 14, slipped toward inside end 17 of tube 14, and over section 22, until rear face 23 of sight mounting ring 24 contacts front face 21 of raised stop 20. The width dimension of sight mounting ring 24 or 25, as measured along the longitudinal axis of tube 14, is greater than the width of section 22 measured in the same manner.

FIGS. 1 and 2 also depict raised projection 26 extending from the perimeter of sight mounting rings 24 and 25. Raised projection 26 incorporates sighting means 28, oriented longitudinally with the barrel of the shotgun, and viewable from the perspective of the shooter. Sighting means 28 can be a fiber optic rod or as simple as a through hole in raised projection 26. Sighting means 28 is positioned on raised projection 26 so that when sight mounting ring 24 or 25 is slipped over tube 14 so that rear face 23 of the sight mounting ring contacts front face 21 of raised stop 20, sighting means 28 is at a height above the surface of raised stop 20.

FIGS. 1 and 2 depict two slightly different embodiments of sight mounting rings. Sight mounting ring 24 in FIG. 1 and sight mounting ring 25 in FIG. 2 differ in that sight mounting ring 25 has shoulder 30 extending from raised projection 26 over rear face 23 of sight mounting ring 25. Shoulder 30 has approximately the same radius as the outside radius of raised stop 20, so that, as seen in FIG. 3, shoulder 30 overlaps and fits snugly onto raised stop 20.

Figure 3:
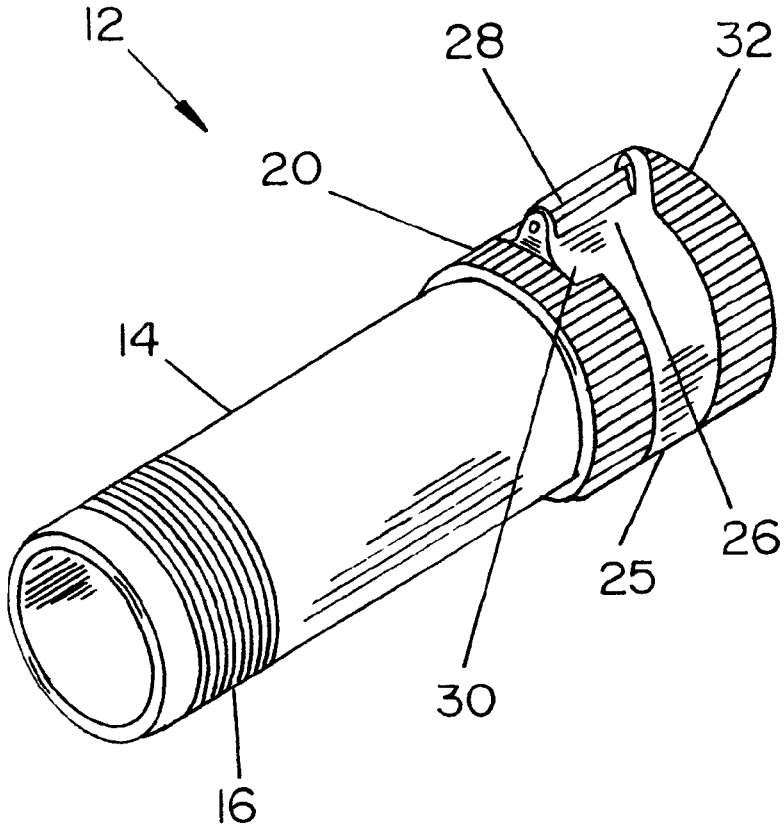
FIG. 3 is a perspective view of the assembled shotgun sighting apparatus.

FIGS. 1 and 3 show an annular nut 32 whose inside diameter is threaded such that it can easily be threaded onto threads 18 at the discharge end 19 of tube 14. In the preferred embodiment the surface of annular nut 32 is a straight knurl.

Figure 4:
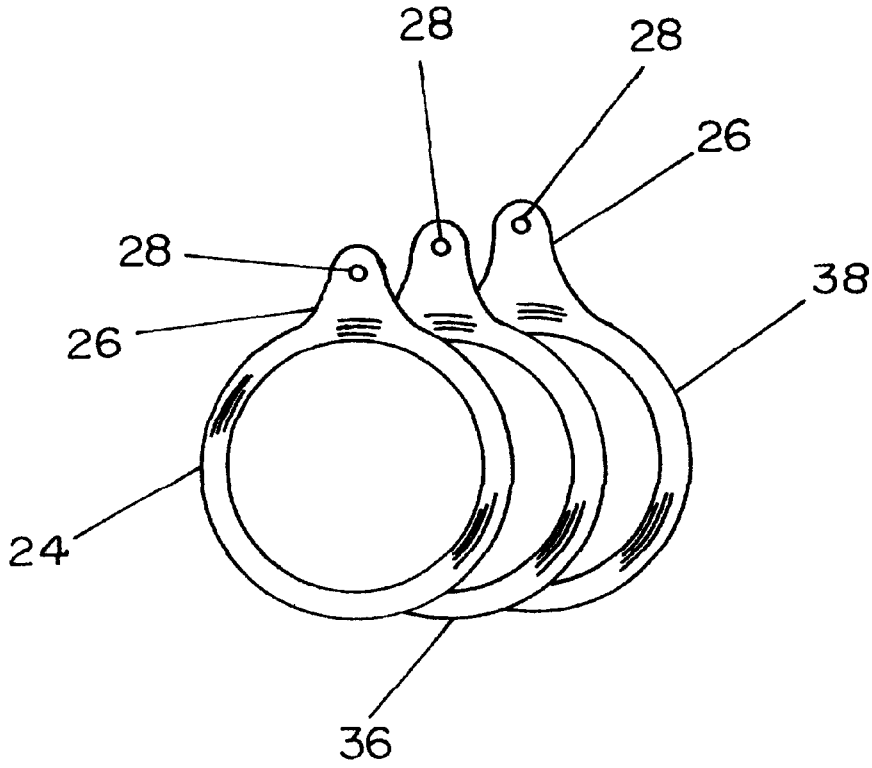
FIG. 4 is a view of three sight mounting rings of differing heights, as seen from the shooter's perspective.

FIG. 4 depicts sighting means 28 when mounted on three different sight mounting rings 24, 36, and 38 as seen from the shooter's perspective. Each sight mounting ring has a raised projection 26 of a different height from the other sight mounting rings, which places sighting means 28 at a different height relative to the gun barrel for each sight mounting means used.

In the typical operation of the present invention, threads 16 of tube 14 are screwed into the discharge end of the shotgun barrel 10. As shown assembled in FIG. 3, sight mounting ring 25 is slipped over threads 18 and over section 22 of tube 14 until its rear face 23 contacts front face 21 of raised stop 20. Annular nut 32 is then screwed onto threads 18 and moves threadably toward the front face 27 of sight mounting ring 25 until ring 25 is tightly clamped in place between stop 20 and annular nut 32.

Figure 5:
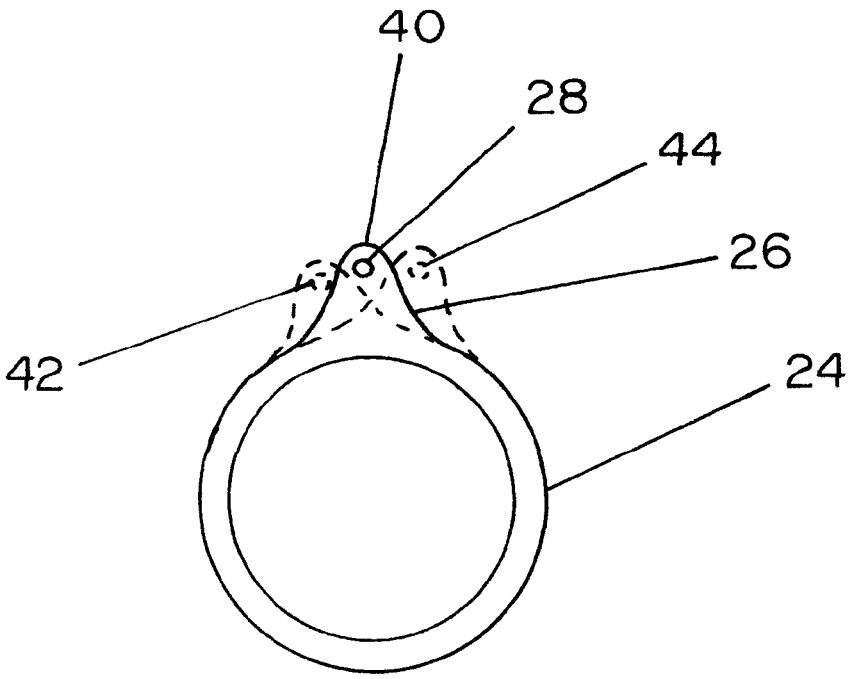
FIG. 5 is an overlay of the views of a single sight mounting ring as it is rotated to the left and to the right of the shotgun barrel, as seen from the shooter's perspective.

FIG. 5 is an overlay of the views of single sight mounting ring 24 as it is rotated to the left and to the right of the central position 40 on the shotgun barrel, as seen from the shooter's perspective.

With the apparatus assembled as shown in FIG. 3, the shooter can make all necessary adjustments to point of impact, elevation and windage. For example, as shown in FIG. 5, adjustments in the horizontal plane may be made by first loosening threaded nut 32, rotating ring 24 which moves sighting means 28, which is installed on projection 26, from its usual central position 40 to the left as seen in position 42, or to the right as seen in position 44, and re-tightening threaded nut 32.

Adjustments in the vertical plane may similarly be made simply by loosening and removing annular nut 32, removing sight mounting ring 24, and replacing it with another sight mounting ring 36 or 38 which has its sighting means 28 at a different height, as shown in FIG. 4, and re-tightening annular nut 32.

It is also clear that the present invention is portable and contemplates removing tube 14 from the shotgun or other gun in which it was previously installed, and installing it in another gun whose barrel is designed to accept a threaded tube. In this manner the apparatus may quickly and easily installed in another gun. New settings can, of course, be set on the other gun at any time.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. A sighting apparatus for use while shooting a gun comprising:

(a) a tube with an exterior surface and a straight length, the tube including attachment means near a first end of the tube for securing the tube onto a muzzle end of a gun and having a second end remote from the muzzle end of the gun;

(b) at least two interchangeable sights mountable on the exterior surface of the tube, each sight having a projection extending from the sight with sighting means attached to the projection, and the projection on each sight having a different height above the exterior surface of the tube; and (c) securing means to hold an interchangeable sight in place at a selected rotational position around the tube, the securing means permitting the sight to be replaced with another sight.

2. The apparatus of claim 1 wherein the tube is a tube having threads on the exterior surface near the first end for screwing the tube into a muzzle end of a gun.

3. The apparatus of claim 1 wherein each interchangeable sight is a ring which is dimensioned so that the sight can be manually slipped concentrically around the exterior surface of the tube.

4. The apparatus of claim 1 wherein the sighting means is a fiber optic element aligned with the straight length of the tube.

5. The apparatus of claim 3 wherein the securing means holding the sight in place is a nut threaded onto threads formed on the exterior surface of the second end of the tube clamping the sight against a raised stop formed on the exterior of the tube.

6. The apparatus of claim 5 wherein the ring includes a shoulder extending from the ring which overlaps the raised stop.

7. A method for adjusting a gun's sight in horizontal planes, comprising:

installing a sighting apparatus onto a muzzle end of a gun for use while shooting the gun, the sighting apparatus comprising: a tube having threads on an exterior surface near a first end for securing the tube to a muzzle end of a gun and a second end remote from the muzzle end of the gun, a sight that is a ring which is dimensioned so that the sight can be manually slipped concentrically around the exterior surface of the tube and rotated relative to the tube, the sight having a projection extending from the sight, with sighting means attached to the projection and located at a first rotational position; and securing means threaded onto threads formed on the exterior surface of the second end of the tube and clamping the sight against a raised stop formed on the exterior of the tube, the securing means holding the sight in place at a selected rotational position relative to the tube;

loosening the securing means, and rotating the installed sight in an arc around the tube until the projection with sighting means affixed thereto is positioned at a second rotational position desired by the shooter; and re-securing the securing means.

8. A method for adjusting a gun sight in a vertical plane comprising:

installing a sighting apparatus onto a muzzle end of a gun for use while shooting the gun, the sighting apparatus comprising: a tube having threads on an exterior surface near a first end for securing the tube to a muzzle end of a gun and a second end remote from the muzzle end of the gun, a first sight that is a ring which is dimensioned so that the sight can be manually slipped concentrically around the exterior surface of the tube, the first sight having a sighting means attached at a first distance from the muzzle, and a nut threaded onto threads formed on the exterior surface of the second end of the tube and clamping the sight against a raised stop formed on the exterior of the tube;

loosening the nut, removing the installed first sight, and replacing the first sight with a second ring having a sighting means attached at a second distance from the muzzle; and re-securing the nut.

* * * * *